United States Patent [19]

Herzog

[11] Patent Number: 5,067,531

[45] Date of Patent: Nov. 26, 1991

[54] BENCH TOP CONTAINER FILLER

[76] Inventor: Kenneth Herzog, 200 Mill Rd., Riverhead, N.Y. 11901

[21] Appl. No.: 429,047

[22] Filed: Oct. 30, 1989

[51] Int. Cl.[5] ..... B65B 3/32

[52] U.S. Cl. ..... 141/116; 141/177; 141/181; 141/188; 141/260; 141/266; 92/13.4; 222/309; 222/334; 417/403

[58] Field of Search ..... 141/115–117, 141/119, 120, 126, 127, 177, 181, 188, 130, 25–27, 250, 258–261, 263, 264, 266, 267, 284; 222/108–110, 309, 334; 92/13.3, 13.4, 13.8; 417/403, 404; 60/338, 369, 370, 376, 394, 407–409, 419, 469, 907; 128/205.16, 205.18

[56] References Cited

U.S. PATENT DOCUMENTS

| | | | |
|---|---|---|---|
| 1,241,056 | 9/1917 | Tullar | 128/205.18 |
| 2,550,678 | 5/1951 | Deacon | 60/370 X |
| 2,553,788 | 5/1951 | Richardson et al. | 222/309 X |
| 2,895,644 | 7/1959 | Pande | 222/309 X |
| 2,978,149 | 4/1961 | Rosen | 141/116 X |
| 3,023,791 | 3/1962 | Strain | 141/270 |
| 3,066,830 | 12/1962 | Heiss et al. | 141/117 X |
| 3,523,527 | 8/1970 | Foster | 128/205.16 X |
| 3,831,821 | 8/1974 | Doyen | 141/261 X |
| 3,837,534 | 9/1974 | Natelson | 222/309 X |
| 3,971,213 | 7/1976 | Kelley | 60/407 X |
| 4,056,043 | 11/1977 | Sriramamurty et al. | 92/13.2 |
| 4,111,101 | 9/1978 | Obiya et al. | 60/394 X |
| 4,212,416 | 7/1980 | Bennett | 222/309 X |
| 4,227,627 | 10/1980 | Bennett | 222/309 X |
| 4,228,924 | 10/1980 | Gilbert | 222/309 X |
| 4,230,160 | 10/1980 | Buckley | 141/116 |
| 4,235,265 | 11/1980 | Feliks | 141/264 X |
| 4,313,476 | 2/1982 | Bennett et al. | 141/119 X |
| 4,359,075 | 11/1982 | Eberle et al. | 141/177 |
| 4,659,292 | 4/1987 | Wells et al. | 417/403 X |

FOREIGN PATENT DOCUMENTS

| | | | |
|---|---|---|---|
| 0555583 | 2/1960 | Belgium | 92/13 |

*Primary Examiner*—Henry J. Recla
*Assistant Examiner*—Casey Jacyna

[57] ABSTRACT

A bench top volumetric container filler is provided and consists of a mechanism to pump a predetermined amount of fluid from a reservoir into a container by using a volumetric piston pump operated by a vertical pump driving cylinder.

8 Claims, 3 Drawing Sheets

BENCH TOP CONTAINER FILLER

BACKGROUND OF THE INVENTION

The instant invention relates generally to container filing machines and more specifically it relates to a bench top volumetric container filler.

Numerous container filling machines have been provided in prior art that are adapted to supply fluids into containers before the containers are capped. While these units may be suitable for the particular purpose to which they address, they would not be as suitable for the purposes of the present invention as heretofore described.

SUMMARY OF THE INVENTION

A primary object of the present invention is to provide a bench top volumetric container filler that will overcome the shortcomings of the prior art devices.

Another object is to provide a bench top volumetric container filler that will eliminate the antiquated filling system of using multiple cams, chains, belts and numerous moving parts.

An additional object is to provide a bench top volumetric container filler whereby the filling unit can be fine tuned to adjust the volume dispensed by the nozzle with calibrated settings, in addition to the master volume control feature.

A further object is to provide a bench top volumetric container filler that is simple and easy to use.

A still further object is to provide a bench top volumetric container filler that is economical in cost to manufacture and where one to five nozzles can be used simultaneously.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
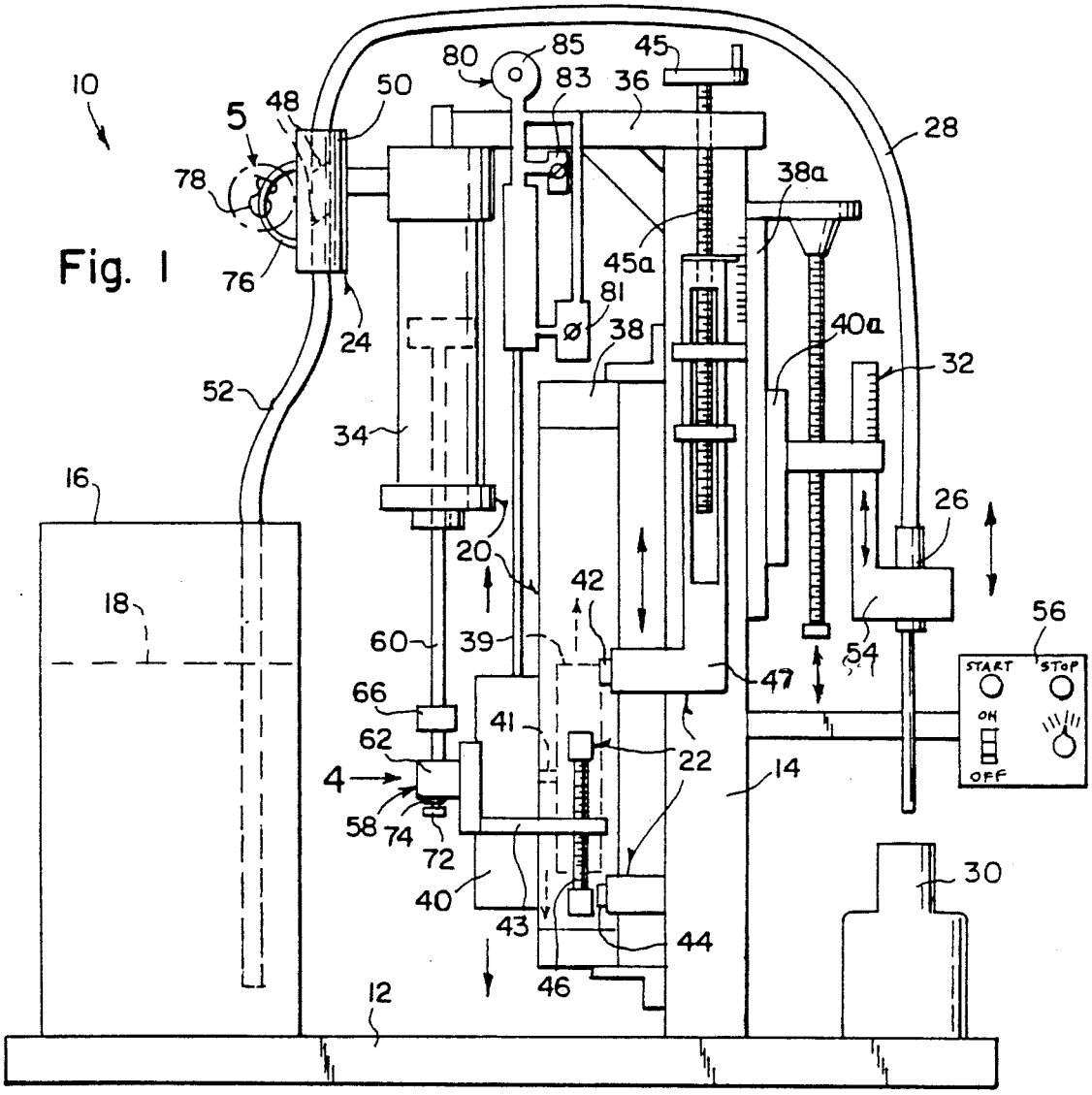
FIG. 1 is a side elevational view of the invention.
Figure 2:
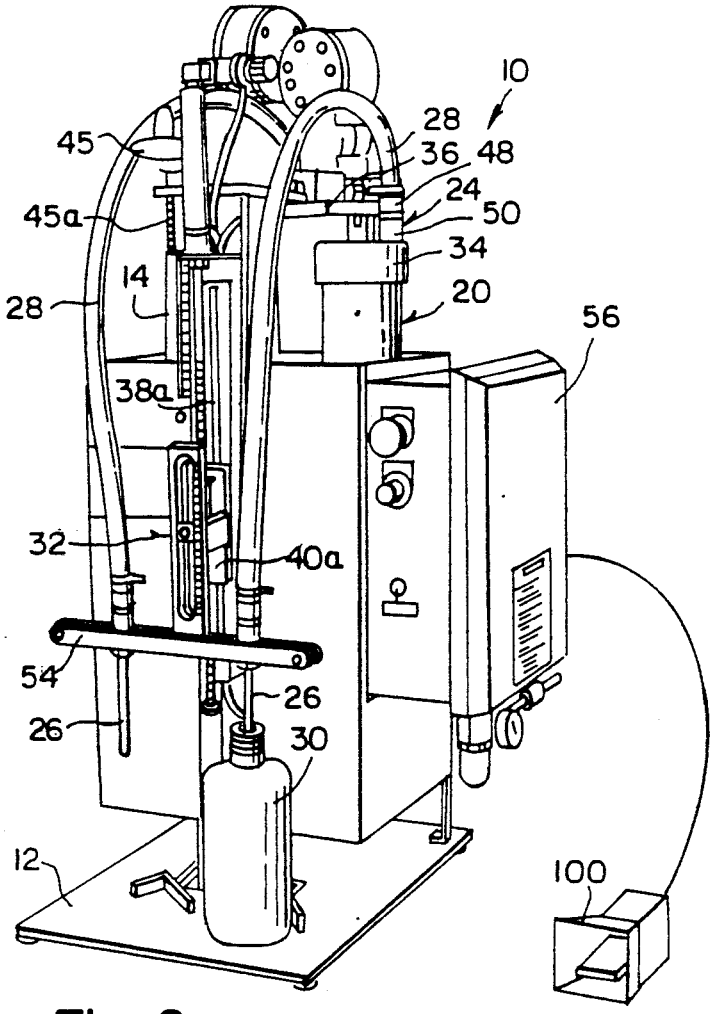
FIG. 2 is a front perspective view of the invention.
Figure 3:
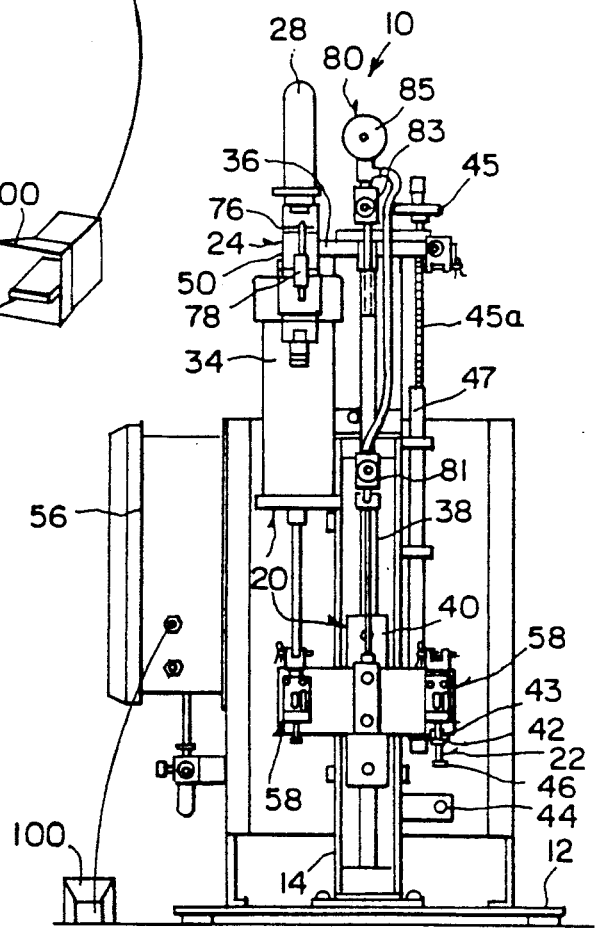
FIG. 3 is a rear elevational view of the invention.

Turning now descriptively to the drawings, in which similar reference characters denote similar elements throughout the several views, FIGS. 1, 2 and 3 illustrate a bench top volumetric container filler 10 that includes a base plate 12 with a vertical stanchion 14 thereon. A reservoir 16 with fluid 18 therein sits upon the base plate 12. A first structure 20 is for pumping the fluid 18 out of the reservoir 16 while a second structure 22 is for controlling volume of the fluid 18 pumped. A third structure 24 is for preventing backflow of the fluid 18 into the reservoir 16. A filling nozzle 26 is fluidly connected via a pump discharge tube 28 to the backflow preventing structure 24. A container 30 sits upon the base plate 12 for receiving the fluid 18 from the filling nozzle 26 and a fourth structure 32 is for controlling height of the filling nozzle 26 to compensate for varying heights of the container 30.

The pumping structure 20 includes a volumetric piston pump 34 suspended from the stanchion 14 by a mounting arm 36. A piston pump driving cylinder 38 has a slide mount 40 connected to the volumetric piston pump 34. The piston pump driving cylinder 38 is vertically suspended from the stanchion 14. Piston 39 pneumatically reciprocated in the vertical piston pump driving cylinder 38 by means not shown , while shaft 41 connected piston 39 to slide mount 40. A plurality of pumps 34 may be driven by a single drive cylinder 38, as seen in FIG. 3 whereby said pumps 34 will each service respectively a plurality of nozzles 26.

The volume controlling structure 22 includes a pair of spaced apart sensor switches 42 and 44 mounted onto said stanchion 14, in which the top sensor switch 42 is adjustable with respect to the bottom sensor switch 44. An activator rod 46 is disposed on bracket 43 and mounted on the slide mount 40 of the piston pump driving cylinder 38 to activate the sensor switches 42 and 44 so as to limit stroke of the slide mount 40. Wheel 45 operates adjusting screw 45*a* that is threaded into a bracket 47 which is reciprocated by turning the hand wheel 45 to move sensor switch 42.

The backflow preventing structure 24 includes a pair of check valves 48 within a tee fitting 50 on upper end of the volumetric piston pump 34 that is connected to a pump intake tube 52 extending upwardly from the reservoir 16.

The height controlling structure 32 includes a vertical adjustable nozzle rack 54 mounted to slide mount 40*a* operated from nozzle rack vertical drive cylinder 38*a* on one side of the stanchion 14 opposite the piston pump driving cylinder 38, for holding the filling nozzle 26. Nozzle rack driving cylinder 38*a* allows for the nozzle rack 54 to slide up and down vertically such that the filling nozzle 26 will enter the container 30 and rise up slowly while the volumetric piston pump 34 is pumping. This will give a bottom up fill or rising fill. A control box 56 is also provided for electrically operating the driving cylinders 38 and 38*a* by a person (not shown) usually by a floor pedal 100.

Figure 4:
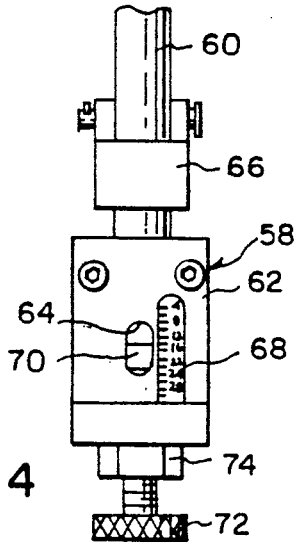
FIG. 4 is an end view taken in direction of arrow 2 in FIG. 1 of the fine tuning adjustment assembly.
Figure 6:
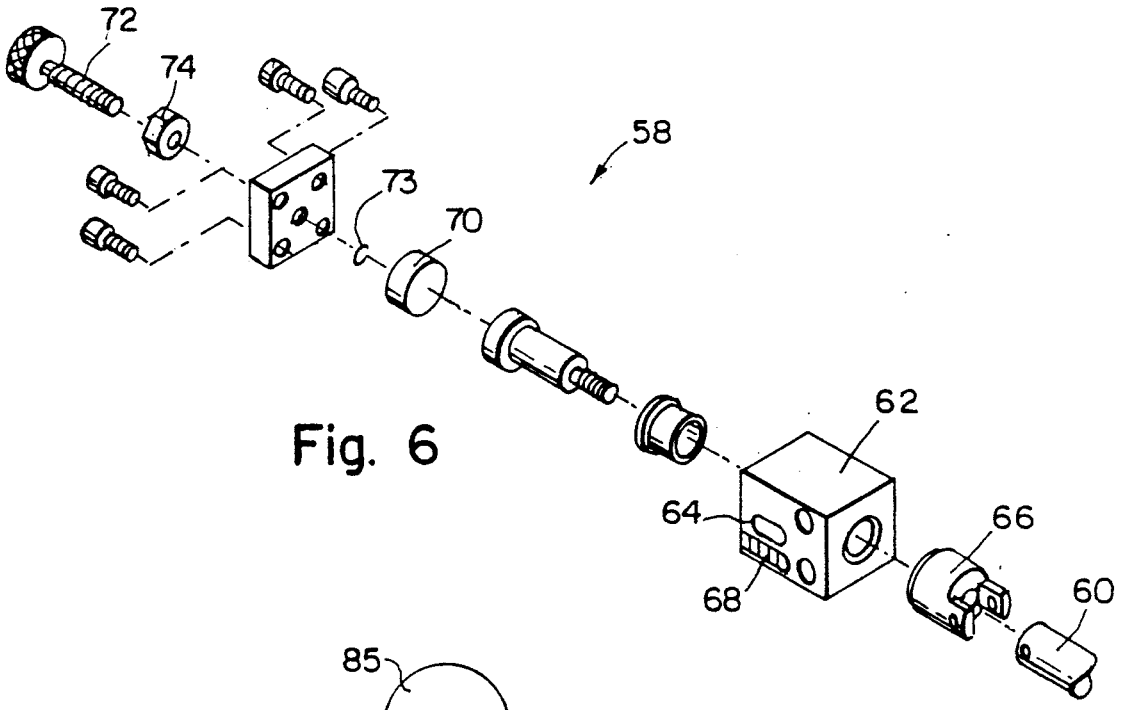
FIG. 6 is an exploded perspective view of the fine tuning adjustment assembly of FIG. 4.

A fine tuning adjustment assembly 58 is disposed between rod 60 of the volumetric piston pump 34 and the slide mount 40 of the vertical pump driving cylinder 38 for additionally controlling stroke of the volumetric piston pump 34. As best seen in FIGS. 4 and 6, the fine tuning adjustment assembly 58 includes an adjustment block 62 that has a window 64 therein, whereby the adjustment block is coupled at 66 to the rod 60. A scale 68 is disposed onto the adjustment block 62 adjacent the window 64. A nylon shoe 70 within the adjustment block 62 is viewed through the window 64 so that the scale 68 can be read from the top of the nylon shoe 70. A toggle shoe clamp 72 is retained by a retaining ring 73 into the nylon shoe 70 of the adjustment block 62 to raise and lower the nylon shoe 70 while a lock nut 74 is threadably disposed onto the toggle shoe clamp 72 for locking the setting of the nylon shoe 70.

Figure 5:
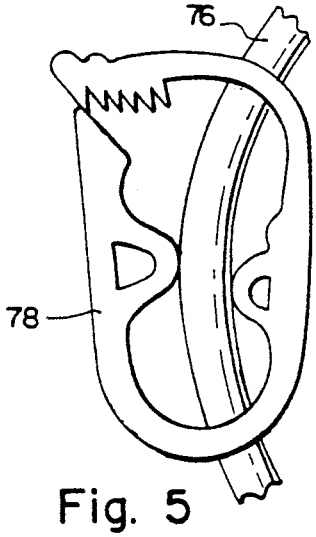
FIG. 5 is an enlarged view as indicated by numeral 3 in FIG. 1 showing the adjustable clip in greater detail.

A suck back vacuum tube 76 is disposed into the tee fitting 50 to bypass the check valves 48 for preventing dripping of the fluid 18 form the nozzle 26 after feed stroke of the volumetric piston pump 34 is completed. An adjustable clip 78, as best seen in FIG. 5, is disposed onto the suck back vaccum tube 76 for controlling the flow of the fluid 18 back into the reservoir 16.

The aspirating or down stroke of rod 60 pulls product into pump 34. When clip 78 is open, some product in tube 28 and discharge tip of nozzle 26 will also be aspirated or sucked back by bypassing the check valves 48. This prevents ant excess product at tip of nozzle 26 from falling or dripping. The varying amount of openness of vacuum tube 76 (see FIG. 5) is adjustable by clip 78 to control amount of suction at nozzle tip when desired.

Figure 7:
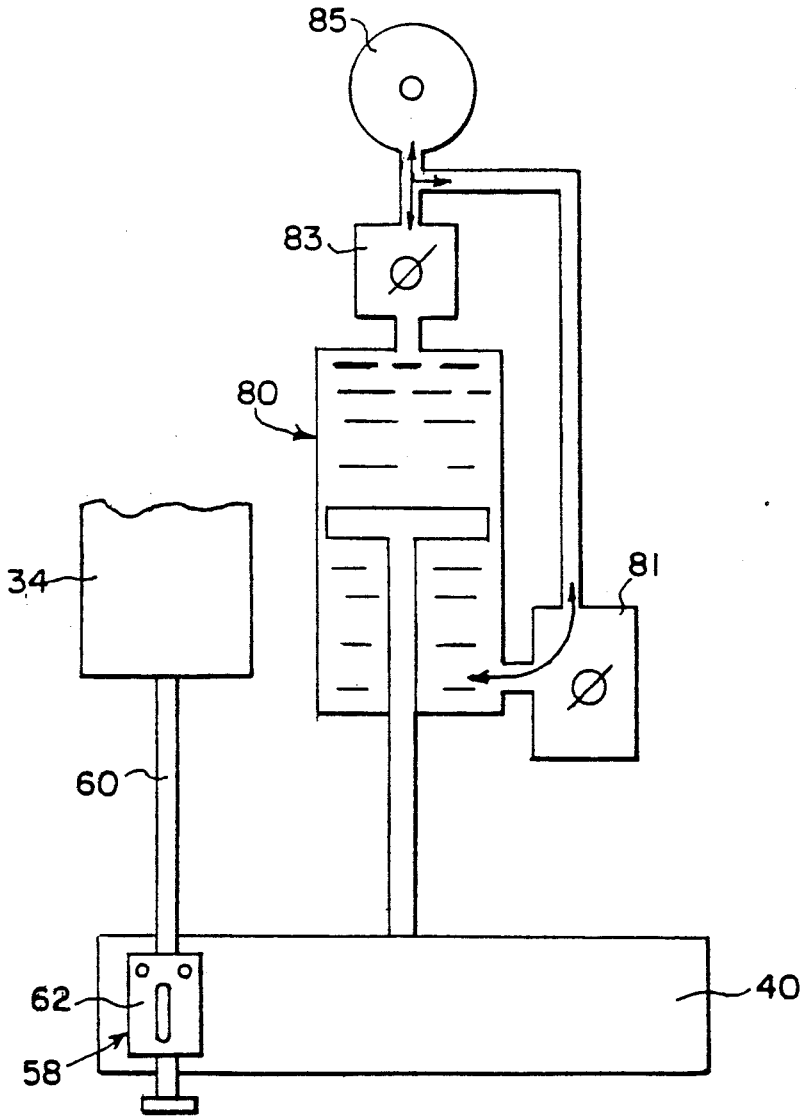
FIG. 7 is a diagrammatic view of the hydraulic/-check cylinder with flow controls to regulate aspirating and discharge speed of fluid by damping the flow rate of the drive cylinder.

To control the speed of piston pump rod 60 moving up (discharging product) and moving down (aspirating product) an oil control device 80 is used (FIG. 7) to control the compressibility of air in the pump driving cylinder 38 which is driven pneumatically. One way needle valves 81 and 83 with check valve in one direction and free flowing in the other direction are used. A spring loaded oil reservoir 85 on the rodless end is used to compensate for excess oil.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bench top volumetric container filler which comprises:

a) a reservoir of fluid;

b) pumping means mounted on a stanchion for pumping the fluid out of said reservoir; including a driving piston rod;

c) means for controlling volume of the fluid pumped, responsive to movement of said rod to control said rod movement;

d) means for preventing backflow of the fluid into said reservoir;

e) a filling nozzle fluidly connected to said backflow preventing means;

f) a container for receiving the fluid from said filling nozzle;

g) means for controlling height of said filling nozzle to compensate for varying heights of said container;

h) means for fine tuning volume of fluid dispensed by said pumping means wherein said piston rod movement is adjustable in addition to the first said means for controlling volume of fluid pumped;

i) a means of controlling aspirating and discharging speeds of said pumping means by a controller piston mounted in a chamber having fluid means for controlling pressures on said controller piston during aspirating and discharge movement; said controller piston being connected and parallel to said driving piston rod wherein said pumping means further includes:

j) a volumetric piston pump with a driven piston rod extending therefrom; and k) a pump driving cylinder with a slide mount connecting to said driving piston rod and said driven piston rod by an adjustment block coacting with said fine tuning means.

2. A bench top volumetric container filler as recited in claim 1, wherein said volume controlling means includes a) a pair of spaced apart sensor switches mounted on said stanchion in which one of said sensor switches is adjustable with respect to other said sensor switches; and said switches are aligned parallel to said piston rods;

b) an adjustable indicator rod disposed adjustably on said slide mount parallel to and for activating said sensor switches so as to limit stroke of said slide mount.

3. A bench top volumetric container filler as recited in claim 2, wherein said backflow preventing means includes a pair of check valves within a tee fitting on upper end of said volumetric piston pump.

4. A bench top volumetric container filler as recited in claim 3, wherein said fine tuning means includes adjustment means disposed between said driven piston rod and said slide mount for additionally controlling stroke length of said piston rod.

5. A bench top volumetric container filler as recited in claim 3, wherein said fine tuning means includes:

a) an adjustment block having a window therein, said adjustment block, adjustably coupled to said driven piston rod;

b) a scale disposed onto said adjustment block adjacent said window;

c) a movable shoe within said adjustment block viewable through said window so that said scale can be read to set the shoe to limit the driven piston rod to a desired stroke length;

d) a shoe clamp threaded into bottom of said adjustment block to raise and lower said shoe.

6. A bench top volumetric container filler as recited in claim 5, further comprising means for preventing drippings of the fluid from said filling nozzle after feed stroke of said volumetric piston pump is completed.

7. A bench top volumetric container fuller as recited in claim 6, wherein said dripping preventing means is a suck back vacuum tube disposed into said tee fitting to bypass said check valves.

8. A bench top volumetric container filler as recited in claim 7, further comprising an adjustment clip disposed onto said suck back vacuum tube for controlling the flow of the fluid back into said reservoir, said clip having opposing ends relatively movable with interlocking teeth for retaining the clip in variable degrees of clamping pressure on said tube.

* * * * *